US011097435B2

(12) United States Patent
Sterzi

(10) Patent No.: US 11,097,435 B2
(45) Date of Patent: Aug. 24, 2021

(54) ELECTRIC HAIR CLIPPER

(71) Applicant: Gamma Più S.r.l., Brescia (IT)

(72) Inventor: Paolo Sterzi, Brescia (IT)

(73) Assignee: GAMMA PIÙ S.R.L., Brescia (IT)

( * ) Notice: Subject to any disclaimer, the term of this patent is extended or adjusted under 35 U.S.C. 154(b) by 0 days.

(21) Appl. No.: 16/578,193

(22) Filed: Sep. 20, 2019

(65) Prior Publication Data

US 2021/0008738 A1 Jan. 14, 2021

(30) Foreign Application Priority Data

Jul. 9, 2019 (IT) ..... 102019000011250

(51) Int. Cl.

| | |
|---|---|
| ***B26B 19/06*** | (2006.01) |
| ***B26B 19/38*** | (2006.01) |
| ***B26B 19/04*** | (2006.01) |
| ***B26B 19/12*** | (2006.01) |

(52) U.S. Cl.

CPC ..... *B26B 19/06* (2013.01); *B26B 19/04* (2013.01); *B26B 19/042* (2013.01); *B26B 19/3853* (2013.01); *B26B 19/3873* (2013.01); *B26B 19/12* (2013.01)

(58) Field of Classification Search

CPC ..... B26B 19/06; B26B 19/12; B26B 19/3853; B26B 19/3873; B26B 19/042; B26B 19/04

USPC ..... 30/43.92, 34.05, 231, 537, 298.4

See application file for complete search history.

(56) References Cited

U.S. PATENT DOCUMENTS 3,493,793 A * 2/1970 Niemela ..... H02K 33/06 310/29
3,811,188 A * 5/1974 Brenneman ..... B26B 19/02 30/34.05
3,903,440 A * 9/1975 Paule ..... B29C 65/606 310/50
4,426,776 A * 1/1984 Kakumoto ..... B26B 19/105 30/34.1
4,926,552 A * 5/1990 Otsuka ..... B26B 19/04 30/346.51
5,088,200 A * 2/1992 Piwaron ..... B26B 19/06 30/216
5,383,273 A * 1/1995 Muller ..... B26B 19/04 30/43
6,082,005 A * 7/2000 Tezuka ..... B26B 19/02 30/43.92
6,112,414 A * 9/2000 Andis ..... B26B 19/3826 30/231
6,219,920 B1 * 4/2001 Klein ..... B26B 19/048 30/346.51
6,317,982 B1 * 11/2001 Andrew ..... B26B 19/102 30/34.1

(Continued)

FOREIGN PATENT DOCUMENTS

| | | |
|---|---|---|
| CN | 108274496 A | 7/2018 |
| EP | 1332843 A1 | 8/2003 |
| EP | 1775079 A1 | 4/2007 |

OTHER PUBLICATIONS

The Italian Search Report dated Feb. 13, 2020, 9 pages, for the priority Italian Patent Application No. 102019000011250.

*Primary Examiner* — Sean M Michalski
(74) *Attorney, Agent, or Firm* — Polsinelli PC

(57) ABSTRACT

An electric hair clipper comprises a blade and a casing, consisting of an upper shell, a lower shell and a screen removable from the lower shell to leave the blade in evidence.

10 Claims, 6 Drawing Sheets

(56) References Cited

Figure 1B:
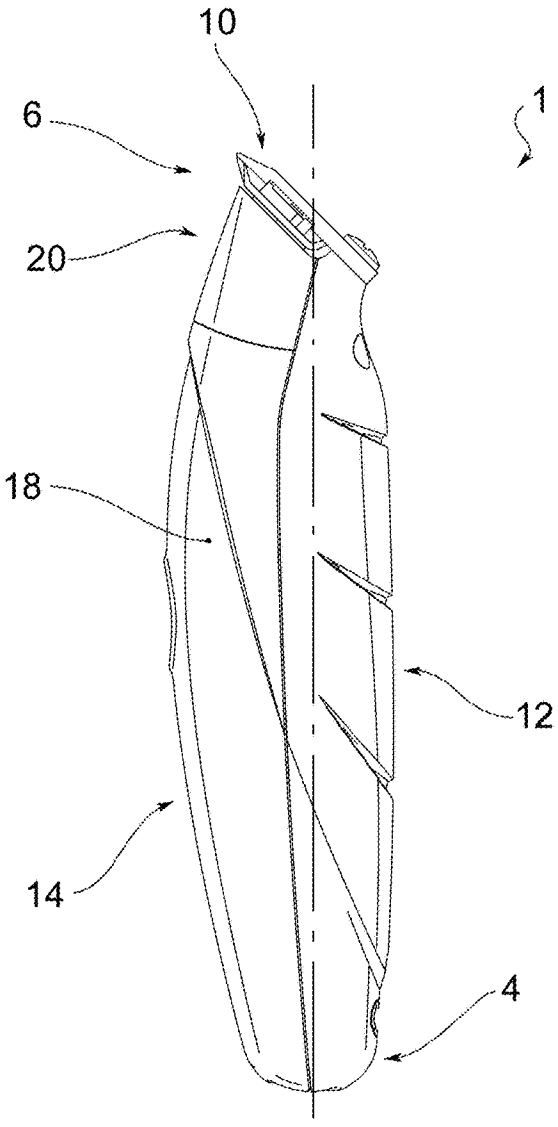

U.S. PATENT DOCUMENTS 6,378,210 B1 * 4/2002 Bickford ..... B26B 19/3806 30/122
6,782,625 B1 * 8/2004 Wong ..... B26B 19/382 30/34.05
7,188,422 B2 * 3/2007 McCambridge ..... B26B 19/06 30/122
7,367,127 B2 * 5/2008 Nakakura ..... B26B 19/20 30/201
7,426,785 B2 * 9/2008 Ho ..... B26B 19/265 30/216
8,136,250 B2 * 3/2012 Floessholzer ..... B26B 19/3846 30/43.92
10,226,872 B2 * 3/2019 Wilson ..... B26B 19/046
2002/0162226 A1 11/2002 Abraham et al.
2003/0005585 A1 * 1/2003 Rizzuto, Jr. ..... B26B 19/205 30/43.92
2003/0029042 A1 * 2/2003 Wilcox ..... B26B 19/105 30/34.1
2003/0101591 A1 * 6/2003 Romani ..... B26B 19/44 30/133
2005/0262695 A1 * 12/2005 Ouchi ..... B26B 19/28 30/43.92
2006/0042093 A1 * 3/2006 Dirks ..... B26B 19/06 30/43.9
2008/0250645 A1 * 10/2008 Tringali ..... B26B 19/46 30/34.05
2009/0000039 A1 * 1/2009 St. John ..... E04G 23/08 7/138
2010/0229396 A1 * 9/2010 Bednar ..... B26B 19/02 30/34.1
2011/0067244 A1 * 3/2011 Eichhorn ..... B26B 19/044 30/43.92
2011/0167639 A1 * 7/2011 Lau ..... B26B 19/06 30/34.1
2011/0289777 A1 * 12/2011 Quan ..... B26B 19/06 30/43.92
2012/0084983 A1 * 4/2012 Moseman ..... B26B 19/28 30/43.92
2015/0113747 A1 * 4/2015 May ..... A61C 17/3481 15/22.1
2015/0165630 A1 * 6/2015 Shimizu ..... B26B 19/044 30/43.92
2017/0182671 A1 * 6/2017 Fu ..... B26B 19/3886
2018/0085933 A1 * 3/2018 Bady ..... B26B 19/3846
2018/0085942 A1 * 3/2018 Perez Lopez ..... B26B 19/40
2020/0189135 A1 * 6/2020 Peterson, Jr. ..... B26B 19/3846

* cited by examiner

ELECTRIC HAIR CLIPPER

The present invention relates to the field of electrical appliances for personal care; in particular, the subject of the present invention is an electric hair clipper.

Electric hair clippers are now widespread, both for personal use and for professional barbers, instead of scissors. In other words, these hair clippers are used not only to shave the hair, but also to make particular haircuts.

Precisely in this regard, it can be seen that haircuts are particularly widespread and fashionable in which it is possible to shave certain areas of the head, for example to make a particularly evident row, or a particular pattern on the nape.

To obtain the desired effect, however, such areas must be shaved with extreme care and precision, and to do this a hair clipper without a spacer is generally used, so that the blade can completely shave the hair.

To operate with extreme precision, it is however necessary for the operator to have the blade clearly visible during the shaving operations; on the other hand, the hair clipper often has a casing, from which the particularly bulky blade emerges, which makes precise shaving operations quite difficult.

The object of the present invention is to provide a hair clipper which meets the requirements of the field and which overcomes the drawbacks mentioned above with reference to the prior art.

Such an object is achieved by an electric hair clipper made according to claim 1; the dependent claims describe further advantageous embodiments.

Figure 1A:
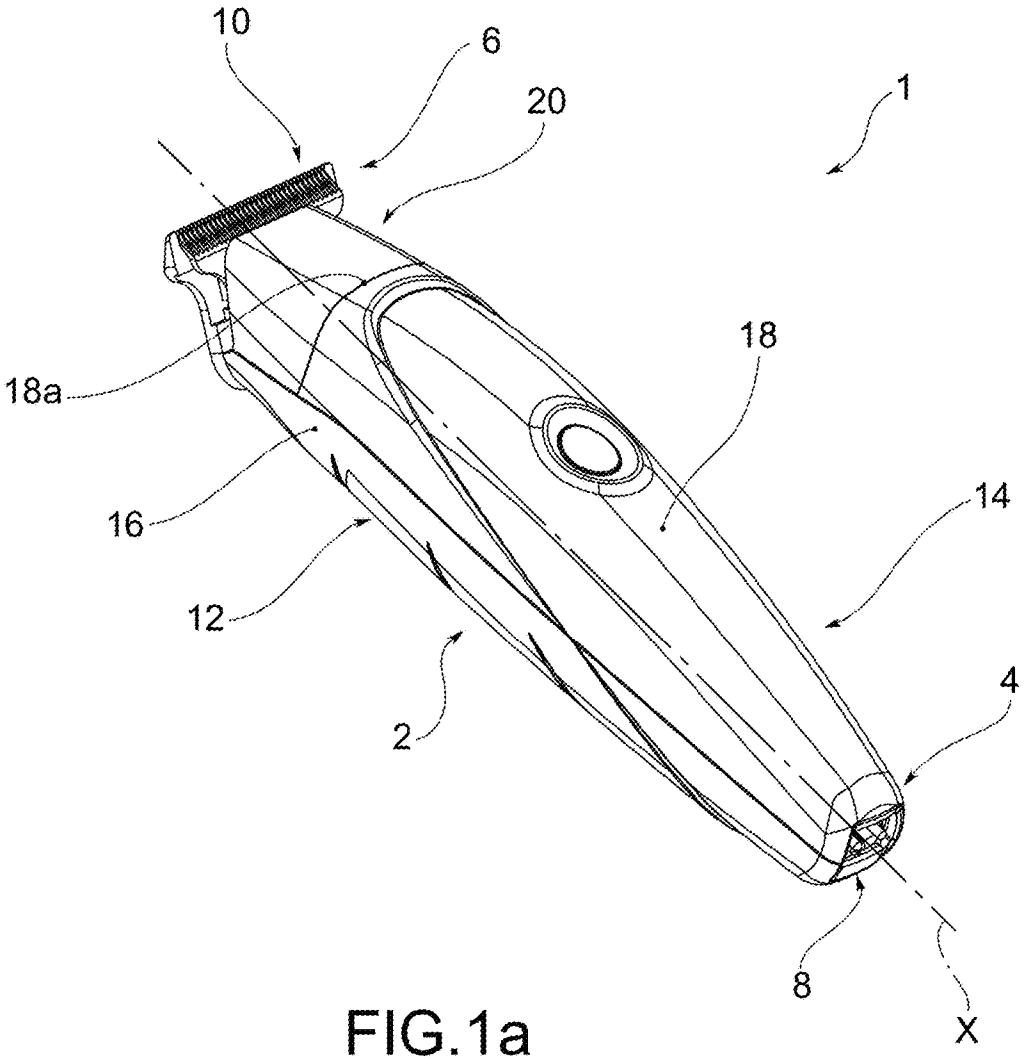

The features and the advantages of the hair clipper according to the present invention will appear more clearly from the following description, made by way of an indicative and non-limiting example with reference to drawings of the accompanying figures, in which:

FIG. 1*a* shows a hair clipper according to an embodiment of the present invention;

FIG. 1*b* shows a side view of the hair clipper of FIG. 1*a;*

Figure 1C:
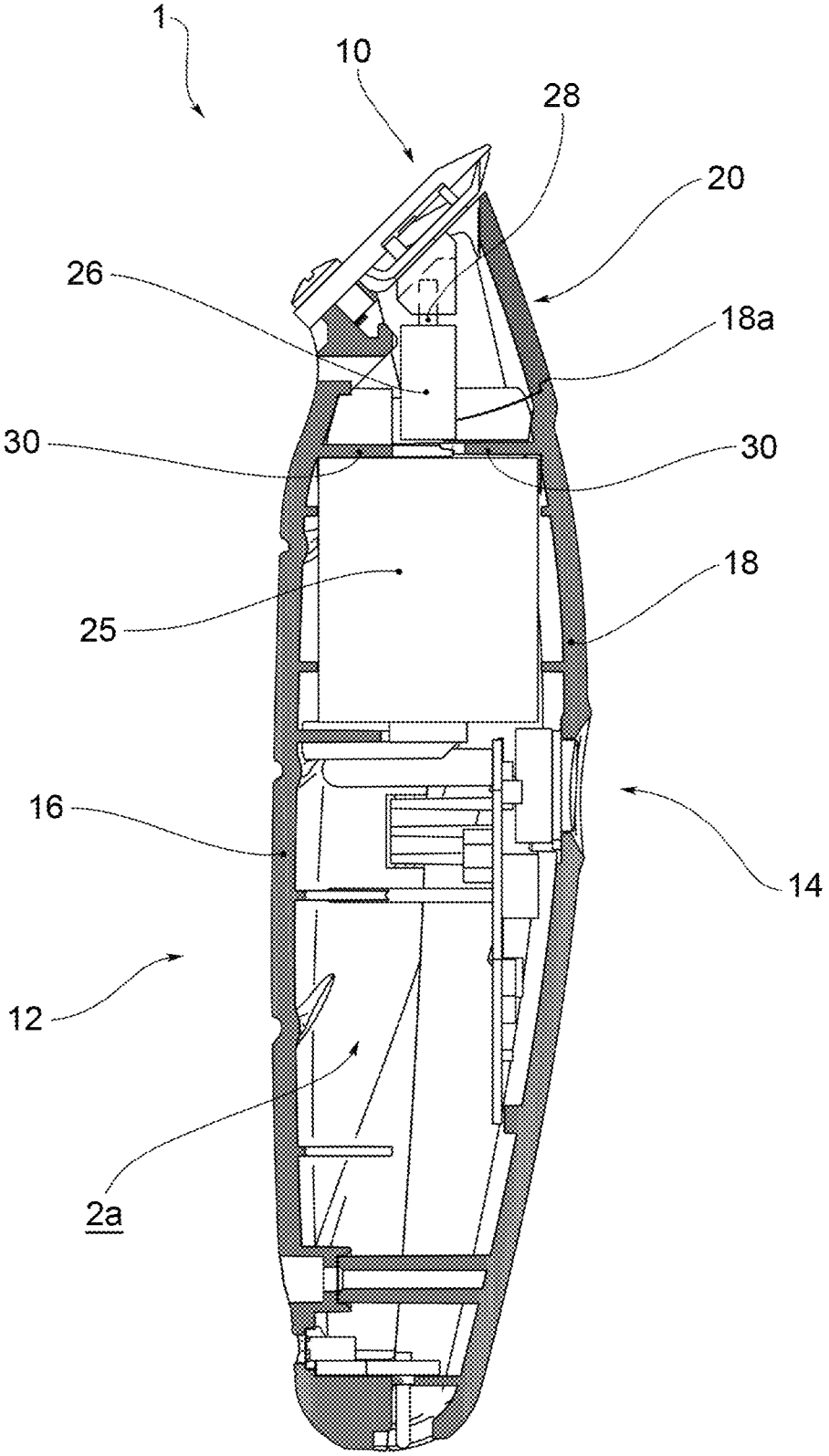

FIG. 1*c* shows a longitudinal section view of the hair clipper of FIGS. 1*a* and 1*b;*

Figure 2B:
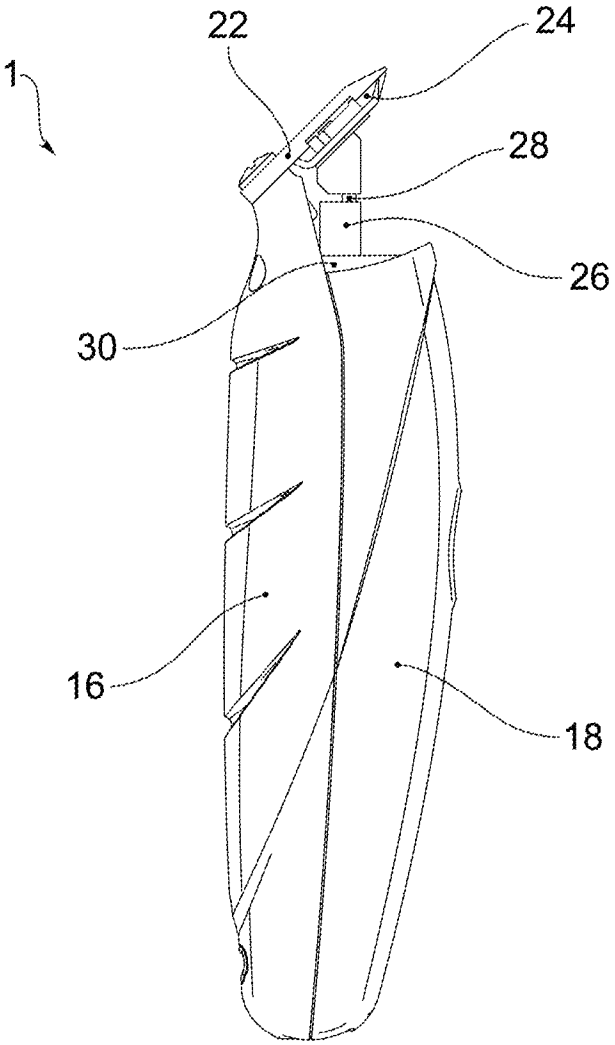
Figure 2A:
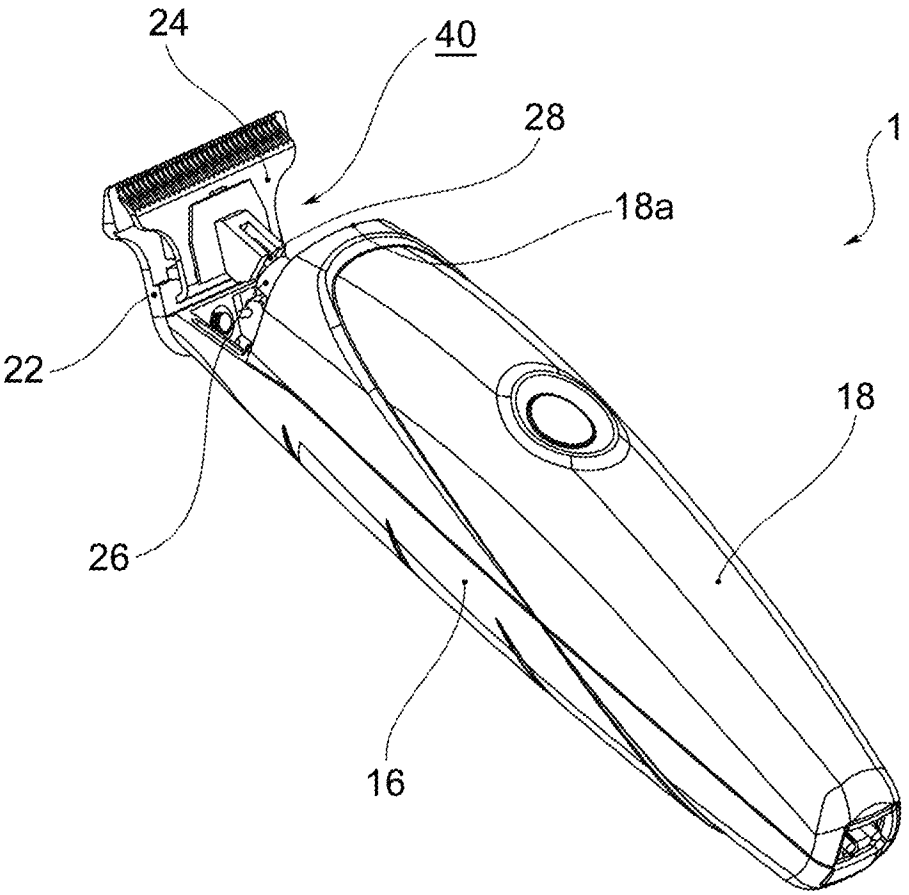

FIG. 2*a* shows the hair clipper of FIGS. 1*a*-1*c*, without a screen;

FIG. 2*b* shows a side view of the hair clipper of FIG. 2*a;*

Figure 2C:
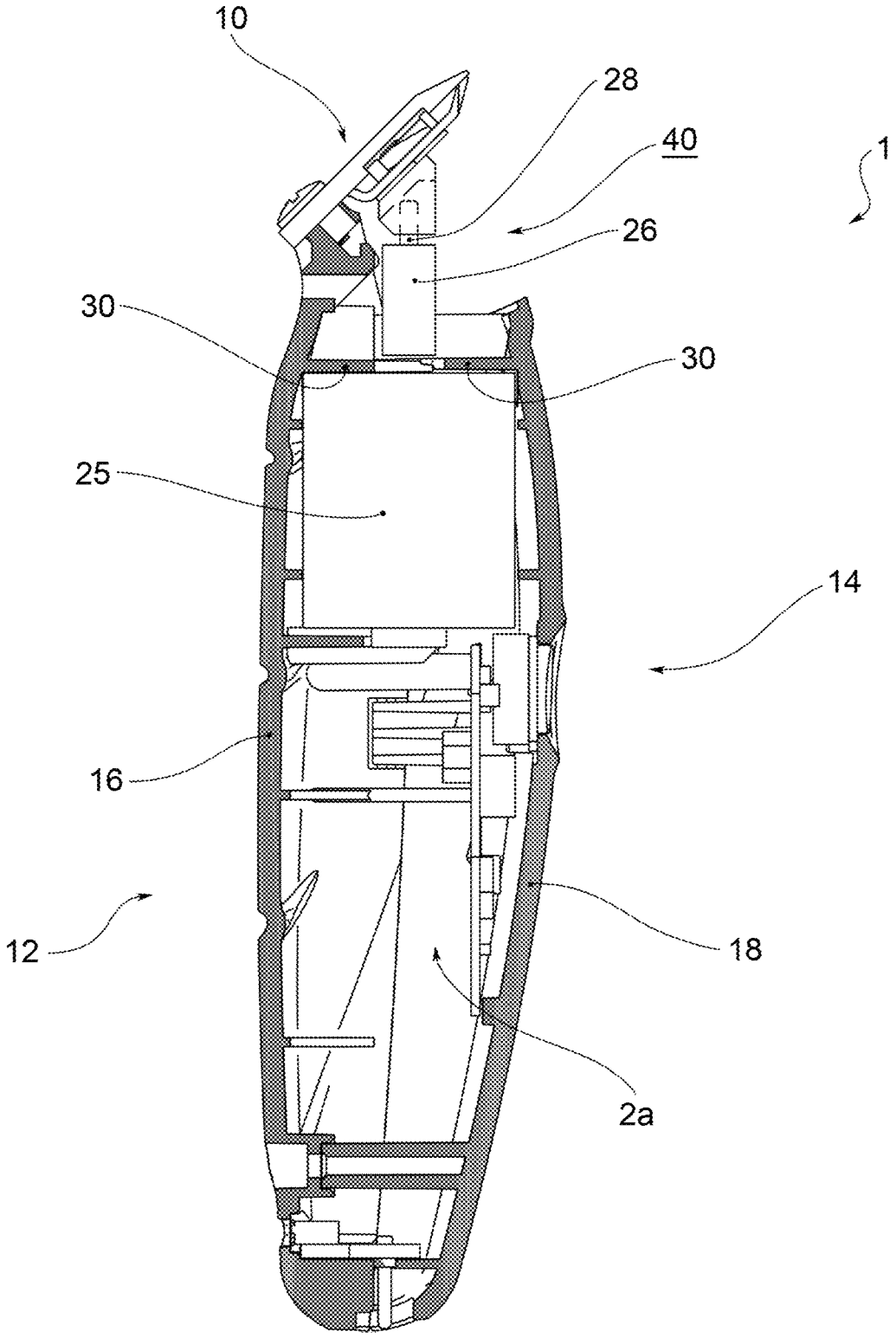

FIG. 2*c* shows a longitudinal section view of the hair clipper of FIGS. 2*a* and 2*b;*

Figure 3B:
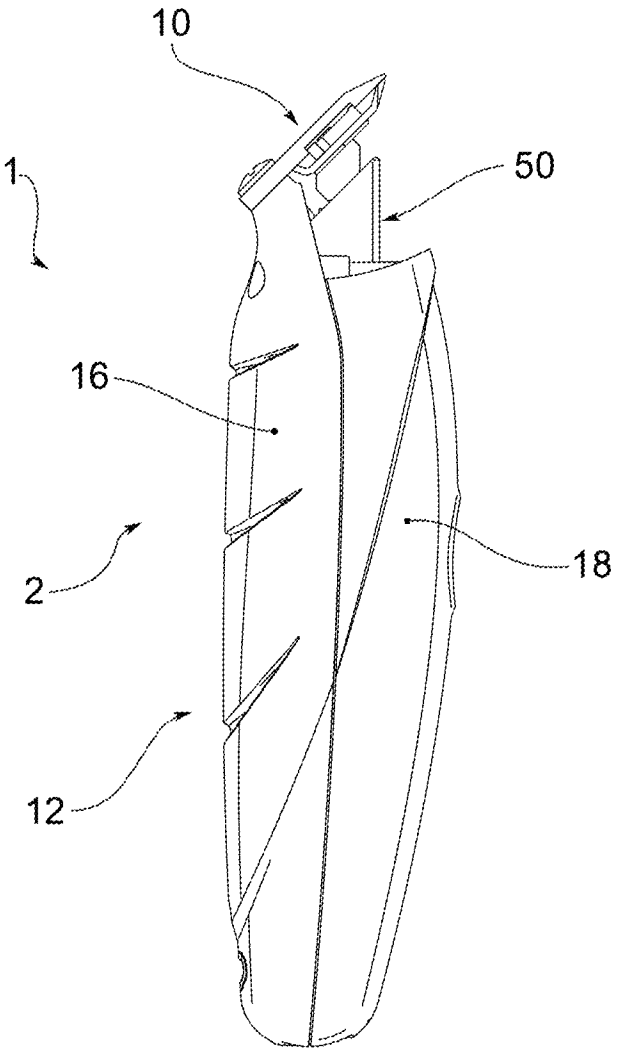
Figure 3A:
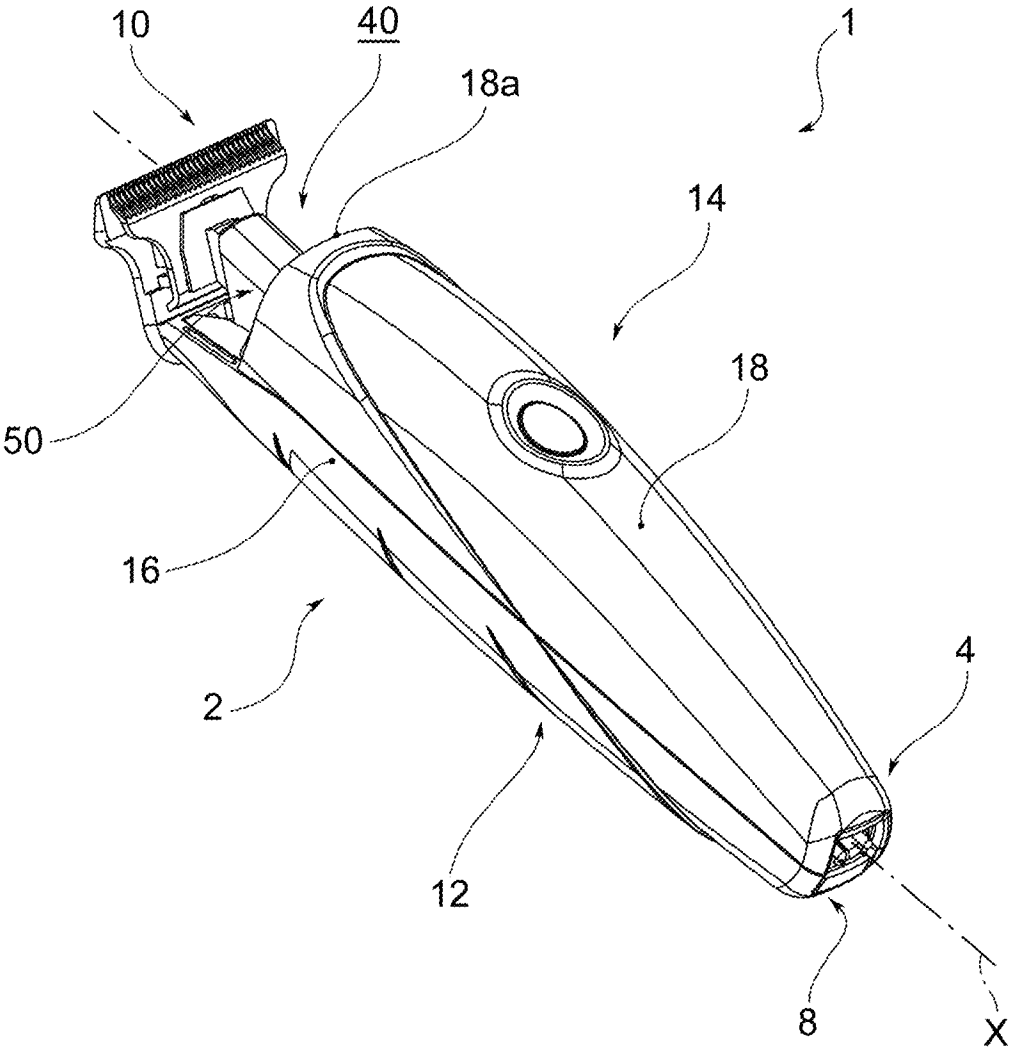

FIG. 3*a* shows a hair clipper according to a further embodiment of the present invention;

FIG. 3*b* shows a side view of the hair clipper of FIG. 3*a;*

Figure 3C:
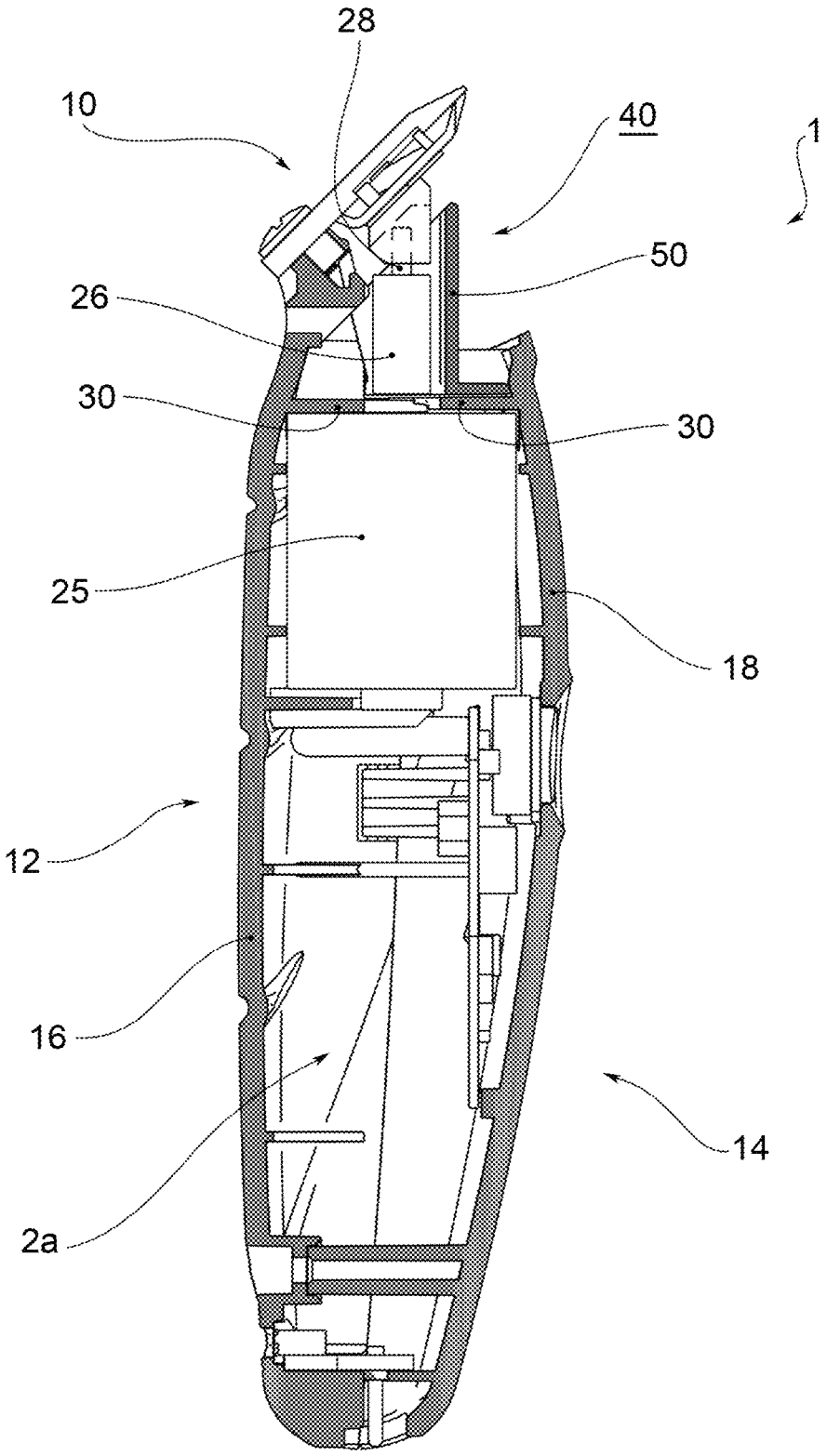

FIG. 3*c* shows a longitudinal section view of the hair clipper of FIGS. 3*a* and 3*b*.

With reference to the drawings of the accompanying figures, an electric hair clipper is generally indicated with reference numeral 1.

Preferably, the hair clipper 1 can be electrically supplied after connection to the electrical network. According to an embodiment variant, the hair clipper is provided with batteries, for example rechargeable.

The hair clipper 1 comprises an outer casing 2, extending along a gripping direction X, between a rear end 4 and a front end 6.

Preferably, at the rear end 4 there is a socket 8 for connection to the mains or to a battery charger.

At the front end 6, instead, there is a blade 10 of the hair clipper, suitable for cutting hair.

The casing 2 is adapted to be gripped by an operator and consists of an upper portion 12 and a lower portion 14.

The upper portion 12 consists of a single upper shell 16, which extends from the rear end 4 to the front end 6, while the lower portion 14 consists of a lower shell 18, terminating at the part facing the blade 10 with a terminal edge 18*a*, and a screen 20, adjacent to the terminal edge 18*a*, i.e. arranged between the lower shell 18 and the blade 10.

The application of the lower shell 18 and of the screen 20 to the upper shell 16 forms the entire casing 2. The screen 20 is removable from the lower shell 18, so as to leave the blade 10 in evidence.

In other words, the lower shell 18 and the upper shell 16 form a handle portion of the hair clipper 1 and define an inner space 2*a* inside them, while the screen 20, external to said handle portion, is removable from the upper shell 18, in order to leave the blade 10 in evidence.

Preferably, the screen can be coupled to the lower shell through a shape coupling; according to further embodiments, it can be coupled to the lower shell by means of a snap coupling or a threaded or magnetic coupling.

Preferably, moreover, the screen can be coupled to the upper shell through a shape coupling; according to further embodiments, it can be coupled to the upper shell by means of a snap coupling or a threaded or magnetic coupling.

According to a preferred embodiment, the blade 10 comprises a fixed part 22, fixed to the front end 6 of the lower shell 16, for example by means of screws, and an oscillating part 24, placed in contact with the fixed part 22 and oscillating transversely; the fixed part 22 and the movable part 24 cooperate to cut the hair.

The hair clipper 1 also comprises an electric motor 25, housed in the inner compartment 2*a* of the casing 2, connected to a rotating spindle 26, which bears an eccentric pin 28 on the head with respect to the axis of rotation of the spindle. The pin 28 is connected to the oscillating part 24 of the blade 10 and imparts the alternating motion thereto.

The inner compartment 2*a* of the housing 2 is separated from the external environment by a protective wall 30, from which the rotating shaft 26 protrudes and which prevents the cut hair from entering the compartment or the voluntary introduction of tools such as a screwdriver.

Once the screen 20 has been removed, between the terminal edge 18*a* of the upper shell 18 and the blade 10, there remains a head compartment 40, in which a part of the rotating shaft 26, the pin 28 and the movable part of the blade 10 are arranged and are visible. The head compartment 40 is separated from the compartment inside the casing 2 by the protective wall 30.

According to a first embodiment, the movable members present in the head compartment 40, and in particular the part of the rotating shaft, the pin and the oscillating part of the blade, are visible (FIGS. 3 and 4).

According to a further embodiment (FIGS. 5 and 6), the hair clipper 1 comprises a protection 50, arranged in the head compartment 40, suitable for covering part of the movable members arranged in the head compartment 40, and in particular the part of the rotating shaft 26 projecting from the protective wall 30 and the pin 28.

According to a preferred embodiment, the protection 50 is removable and can be removed to leave the movable members in view.

According to an embodiment variant, the protection 50 is fixed, for example made in a single piece with the lower shell.

According to an embodiment of the invention, the hair clipper 1 is sold in a kit comprising a plurality of screens which can be removably connected to the lower shell 18, in which each screen has a peculiar colouring or a particular aesthetic pattern, which makes it distinguishable from others.

This allows customizing the clipper according to the tastes of the operator.

According to a still further embodiment, the kit comprises a plurality of interchangeable lower shells, to complete the customization of the hair clipper.

Innovatively, the hair clipper according to the present invention meets the needs of the sector and overcomes the drawbacks mentioned with reference to the prior art, since separating the screen from the lower shell, the blade remains clearly visible and allows the execution of precise shaves.

Advantageously, moreover, the hair clipper maintains high safety standards since the protective wall prevents the accidental or voluntary introduction of tools such as screwdrivers and the like.

According to this advantageous aspect, the protective wall also limits the entry of cut hair or dust into the inner compartment.

Advantageously, moreover, the hair clipper can be customized according to the tastes of the operator.

It is clear that a man skilled in the art may make changes to the hair clipper described above in order to meet incidental needs, all falling within the scope of protection defined in the following claims.

The invention claimed is:

1. An electric hair clipper comprising:

a blade for trimming:

a casing, from which the blade projects, wherein the casing comprises an upper portion and a lower portion coupled to the upper portion, wherein the upper portion comprises an upper shell and the lower portion comprises a lower shell, coupled to the upper shell, the upper shell coupled to the lower shell defines an inner compartment and forms a handle portion of the hair clipper, the lower shell terminates at a terminal edge, and a head compartment is defined between the terminal edge and the blade;

a screen portion, arranged to form a cover of the head compartment when coupled to the upper shell and lower shell, the screen is attachable and removable from the lower shell; and a protection arranged in the head compartment and covered by the screen when the screen is not removed, the protection covers movable members arranged in the head compartment, the protection is removable to leave the movable members visible while the electric hair clipper is in use.

2. The electric hair clipper of claim 1, wherein the screen is coupled to the lower shell through a shape coupling or a snap coupling or a threaded or magnetic coupling.

3. The electric hair clipper of claim 1, wherein the blade comprises a fixed part, fixed to the upper shell, and an oscillating part which the screen is separated from the lower shell, are visible.

4. The electric hair clipper of claim 3, wherein, the hair clipper comprises an electric motor housed in the inner compartment inside the lower shell and upper shell and the movable members, driven by the electric motor, for moving the oscillating part of the blade.

5. The electric hair clipper of claim 4, wherein the casing comprises further comprising a protective wall which that separates the electric motor from the movable members and the inner compartment from the external environment.

6. The electric hair clipper of claim 5, wherein the movable members comprise a rotating shaft projecting vertically from the protection wall in the head compartment.

7. The electric hair clipper of claim 5, wherein the head compartment is separated from the inner compartment by the protection wall.

8. The electric hair clipper of claim 5, wherein the protection vertically extends from the protection wall and covers the movable members.

9. The electric hair clipper of claim 4, comprising at least one rechargeable battery, housed in the inner compartment, and an electrical socket, connected to the battery, for recharging the battery.

10. A kit comprising:

an electric hair clipper of claim 1; and a plurality of interchangeable screens.

* * * * *